US005505420A

United States Patent [19]

Brown

[11] Patent Number: 5,505,420

[45] Date of Patent: Apr. 9, 1996

[54] CEILING FAN STABILIZER

[76] Inventor: Joe K. Brown, 390 Lee Rd. 446, Opelika, Ala. 36801

[21] Appl. No.: 310,312

[22] Filed: Sep. 22, 1994

[51] Int. Cl.[6] ..... B42F 13/00

[52] U.S. Cl. ..... 248/343; 248/674

[58] Field of Search ..... 248/343, 342, 248/906, 674, 317; 416/244 R

[56] References Cited

U.S. PATENT DOCUMENTS

| | | | |
|---|---|---|---|
| 1,093,007 | 4/1914 | Platt | 248/342 |
| 2,943,137 | 6/1960 | Wyngarden | 248/343 X |
| 3,639,752 | 2/1972 | Appleton | 248/342 X |
| 4,410,160 | 10/1983 | Alperin | 248/674 |
| 4,634,345 | 1/1987 | Stanek | 416/244 R |
| 4,645,158 | 2/1987 | Manning | 248/906 X |
| 4,684,092 | 8/1987 | Reiker | 248/343 X |
| 4,788,383 | 11/1988 | Caison | 248/906 X |
| 5,044,582 | 9/1991 | Walters | 248/343 X |
| 5,085,392 | 2/1992 | Perna | 248/906 X |
| 5,154,579 | 10/1992 | Rezek | 248/343 X |
| 5,183,233 | 2/1993 | Lapalomento | 52/39 X |
| 5,242,269 | 9/1993 | Chang | 416/244 R |

*Primary Examiner*—J. Franklin Foss

[57] ABSTRACT

A stabilizer for precluding periodic oscillating motion of a ceiling fan. The inventive device includes a ceiling engagement plate positionable against a portion of the ceiling. A fan alignment block is securable to the depending cylindrical support of the ceiling fan and engages the ceiling plate. A plurality of adjustment fasteners engaged to the alignment block can be selectively adjusted to engage the ceiling plate to preclude movement of the cylindrical support relative to the ceiling.

5 Claims, 4 Drawing Sheets

CEILING FAN STABILIZER

BACKGROUND OF THE INVENTION

1. Field of the Invention

The present invention relates to ceiling fan structures and more particularly pertains to a ceiling fan stabilizer for precluding periodic oscillating motion of the ceiling fan.

2. Description of the Prior Art

The use of ceiling fan structures is known in the prior art. More specifically, ceiling fan structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art ceiling fan structures include U.S. Pat. No. 5,085,392; U.S. Pat. No. 5,044,582; U.S. Pat. No. 4,684,092; U.S. Pat. No. 4,645,158; and U.S. Pat. Des. No. 297,859.

While these devices fulfill their respective, particular objectives and requirements, the aforementioned patents do not disclose a ceiling fan stabilizer for precluding periodic oscillating motion of a ceiling fan which includes a ceiling plate positionable against a portion of the ceiling, a fan alignment block securable to the depending cylindrical support of the ceiling fan, and a plurality of adjustment fasteners threadably engaged to the alignment block which can be selectively adjusted to engage the ceiling plate to preclude movement of the cylindrical support relative to the ceiling.

In these respects, the ceiling fan stabilizer according to the present invention substantially departs from the conventional concepts and designs of the prior art, and in so doing provides an apparatus primarily developed for the purpose of precluding periodic oscillation of a ceiling fan.

SUMMARY OF THE INVENTION

In view of the foregoing disadvantages inherent in the known types of ceiling fan structures now present in the prior art, the present invention provides a new ceiling fan stabilizer construction wherein the same can be utilized for precluding periodic oscillating motion of a ceiling fan. As such, the general purpose of the present invention, which will be described subsequently in greater detail, is to provide a new ceiling fan stabilizer apparatus and method which has many of the advantages of the ceiling fan structures mentioned heretofore and many novel features that result in a ceiling fan stabilizer which is not anticipated, rendered obvious, suggested, or even implied by any of the prior art ceiling fan structures, either alone or in any combination thereof.

To attain this, the present invention generally comprises a stabilizer for precluding periodic oscillating motion of a ceiling fan. The inventive device includes a ceiling engagement plate positionable against a portion of the ceiling. A fan alignment block is securable to the depending cylindrical support of the ceiling fan and engages the ceiling plate. A plurality of adjustment fasteners engaged to the alignment block can be selectively adjusted to engage the ceiling plate to preclude movement of the cylindrical support relative to the ceiling.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ceiling fan stabilizer apparatus and method which has many of the advantages of the ceiling fan structures mentioned heretofore and many novel features that result in a ceiling fan stabilizer which is not anticipated, rendered obvious, suggested, or even implied by any of the prior art ceiling fan structures, either alone or in any combination thereof.

It is another object of the present invention to provide a new ceiling fan stabilizer which may be easily and efficiently manufactured and marketed.

It is a further object of the present invention to provide a new ceiling fan stabilizer which is of a durable and reliable construction.

An even further object of the present invention is to provide a new ceiling fan stabilizer which is susceptible of a low cost of manufacture with regard to both materials and labor, and which accordingly is then susceptible of low prices of sale to the consuming public, thereby making such ceiling fan stabilizers economically available to the buying public.

Still yet another object of the present invention is to provide a new ceiling fan stabilizer which provides in the apparatuses and methods of the prior art some of the advantages thereof, while simultaneously overcoming some of the disadvantages normally associated therewith.

Still another object of the present invention is to provide a new ceiling fan stabilizer for precluding periodic oscillating motion of a ceiling fan.

Yet another object of the present invention is to provide a new ceiling fan stabilizer which includes a ceiling plate positionable against a portion of the ceiling, a fan alignment block securable to the depending cylindrical support of the ceiling fan, and a plurality of adjustment fasteners threadably engaged to the alignment block which can be selectively adjusted to engage the ceiling plate preclude movement of the cylindrical support relative to the ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
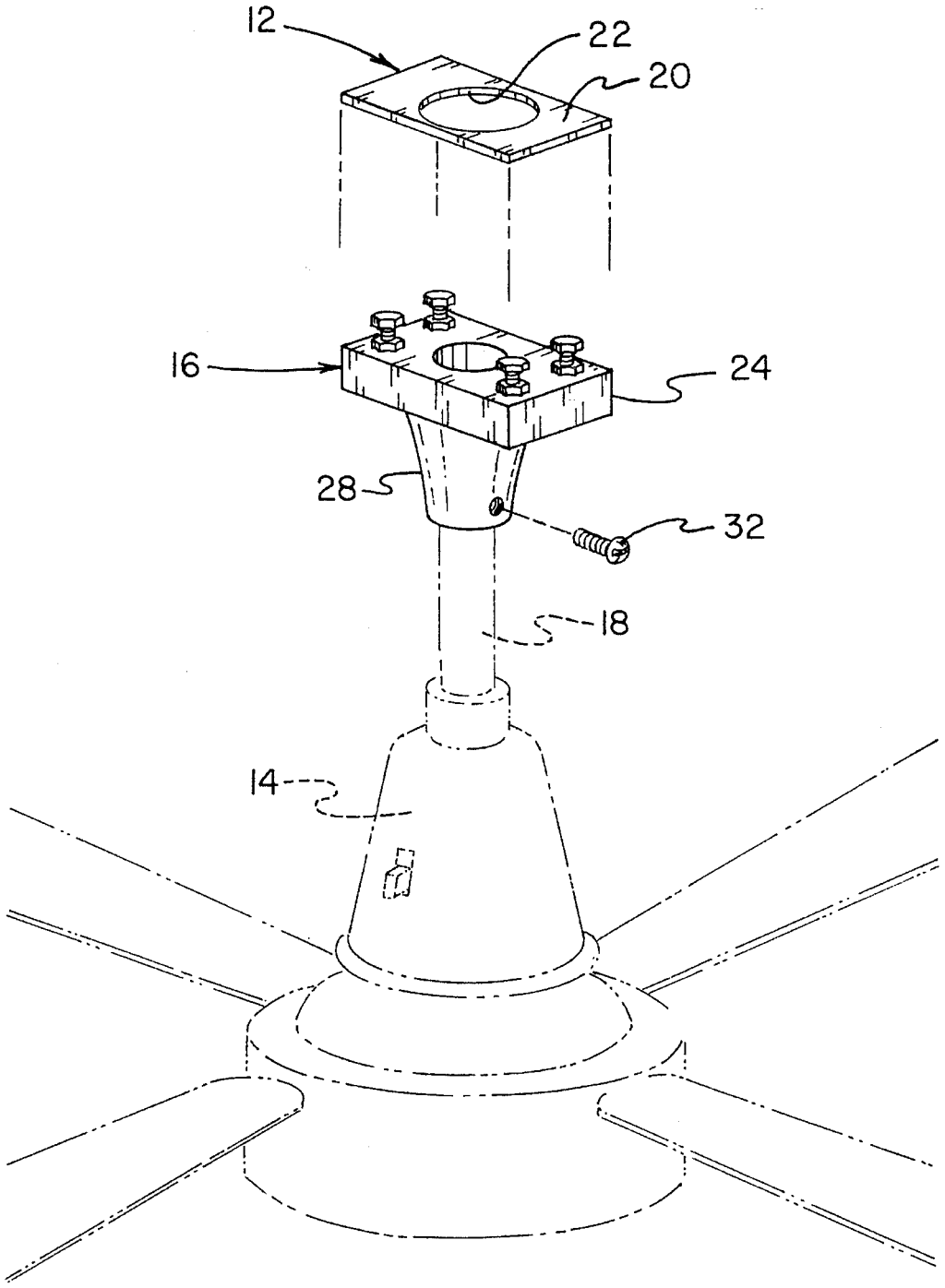
FIG. 1 is an isometric illustration of the ceiling fan stabilizer according to the present invention and coupled to a ceiling fan.
Figure 2:
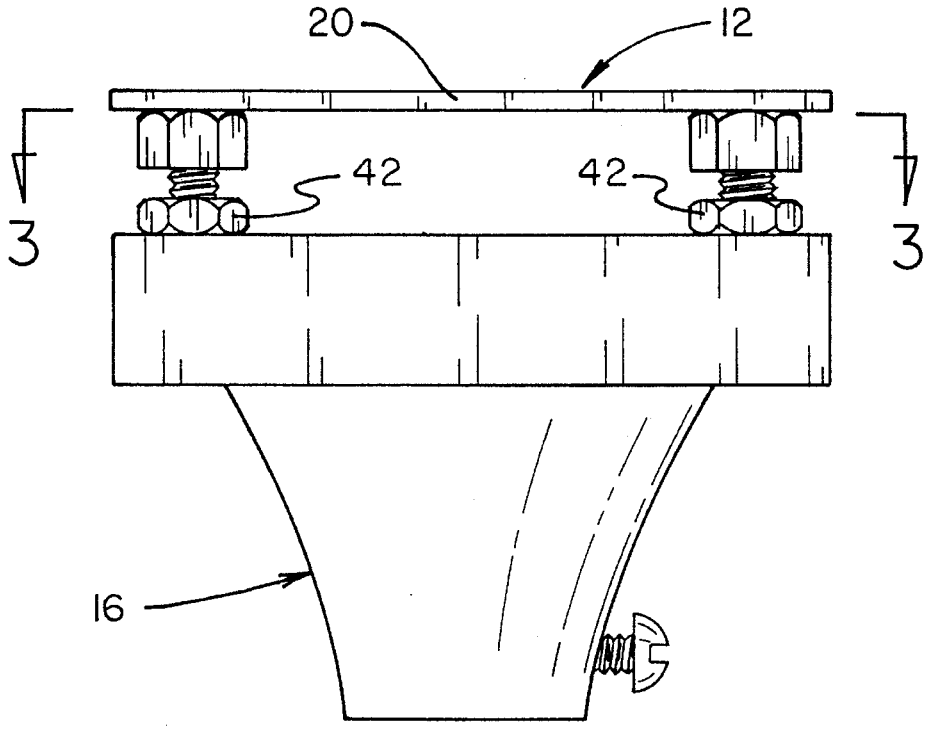
FIG. 2 is a front elevation view of the invention, per se.

With reference now to the drawings, and in particular to FIGS. 1–7 thereof, a new ceiling fan stabilizer embodying the principles and concepts of the present invention and generally designated by the reference numeral 10 will be described.

More specifically, it will be noted that the ceiling fan stabilizer 10 comprises a ceiling engagement means 12 for positioning against a non-unillustrated ceiling surface immediately above and proximal to a ceiling fan 14 hanging from the associated ceiling. A fan alignment means 16 for aligning the ceiling fan 14 relative to the ceiling engagement means 12 is coupled to a depending cylindrical support 18 of the ceiling fan, as shown in FIG. 1. The fan alignment means 16 includes a plurality of adjustment fasteners which can be threadably adjusted relative thereto to engage the ceiling engagement means 12 to secure the depending cylindrical support 18 and the associated ceiling fan 14 against pivoting motion relative to the ceiling to preclude periodic oscillating motion of the ceiling fan.

Figure 6:
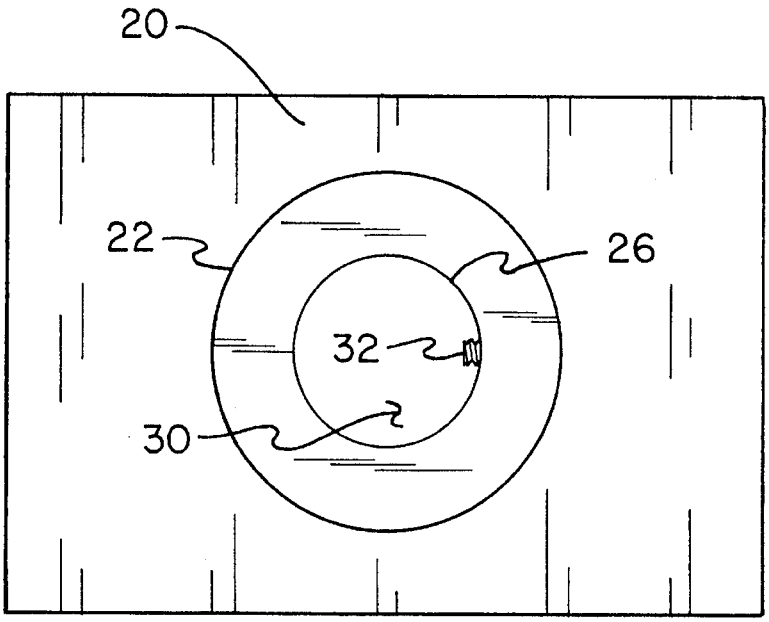
FIG. 6 is a top plan view of the invention as seen from line 6—6 of FIG. 5.

As best illustrated in FIGS. 1 and 6, the ceiling engagement means 12 comprises a substantially rectangular base plate 20 having a base plate center aperture 22 extending therethrough so as to permit positioning of the base plate against the ceiling surface and over the electrical box to which the ceiling fan 14 is electrically and mechanically attached. The base plate 20 is preferably comprised of a rigid metallic material which precludes undesired deformation thereof which could cause damage to ceiling surface. The base plate 20 may also include apertures permitting a direction of threaded fasteners or other securing means therethrough for securement of the base plate to the ceiling.

Figure 5:
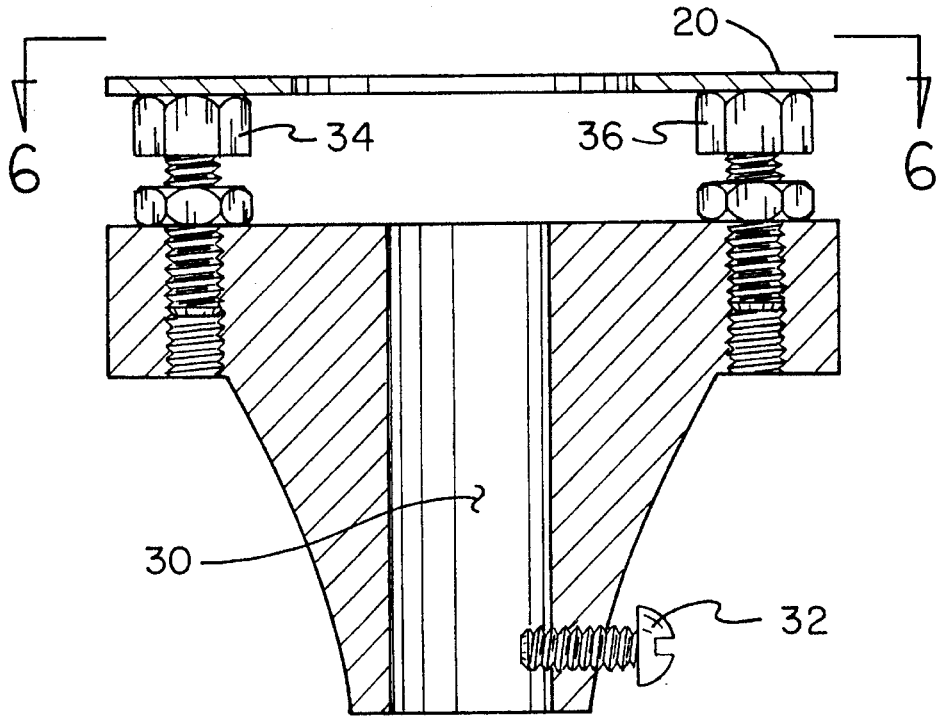
FIG. 5 is a cross sectional view taken along line 5—5 of FIG. 4.
Figure 7:
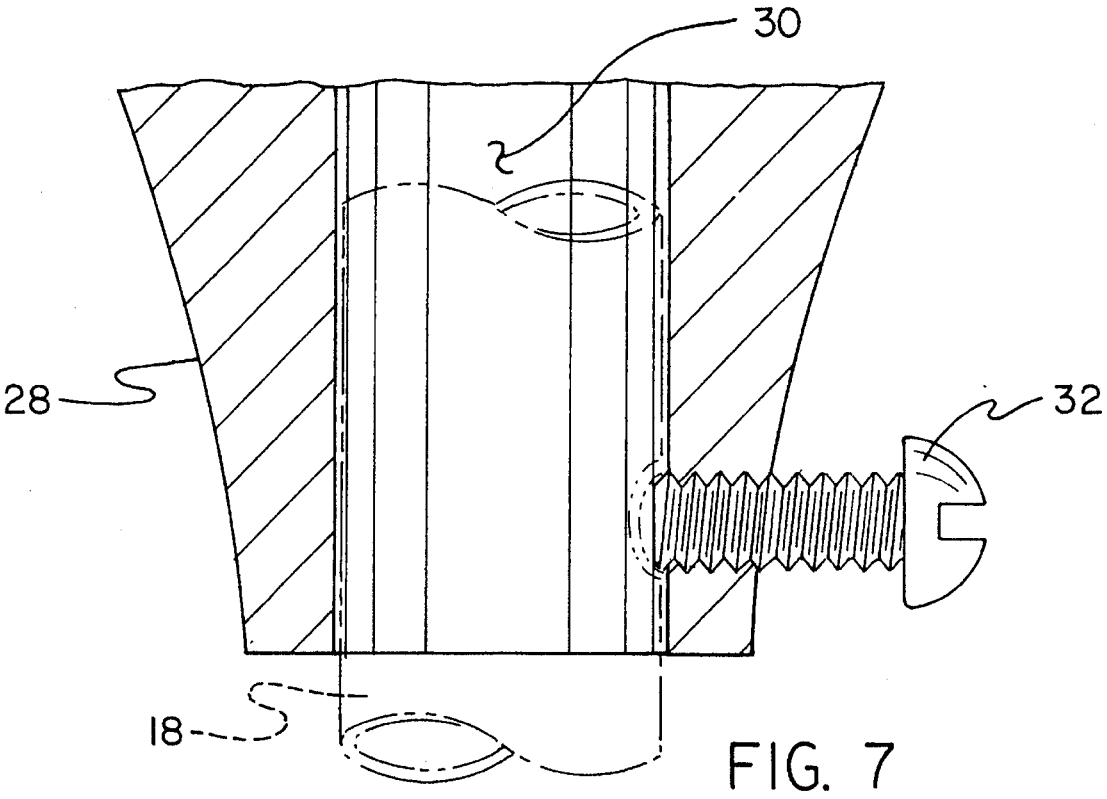
FIG. 7 is a cross sectional view of a portion of the invention illustrating an engagement of the device to the cylindrical support of the ceiling fan.

As shown in FIGS. 2 through 5, the alignment means 16 preferably comprises a mounting block 24 having a mounting block center aperture 26 extending therethrough. A tapered neck 28 extends downwardly from a lower face of the mounting block 24 and includes a neck center aperture 30 aligned and positioned in contiguous communication with the mounting block center aperture 26, as shown in FIG. 5. By this structure, the depending cylindrical support 18 of the ceiling fan 14 can be positioned through the center apertures 26, 30 prior to installation of the ceiling fan to the associated building structure. To secure the fan alignment means 16 relative to the depending cylindrical support 18, a set screw 32 is threadably directed through the tapered neck 28 and operates to engage the depending cylindrical support 18, as shown in FIG. 7.

Figure 3:
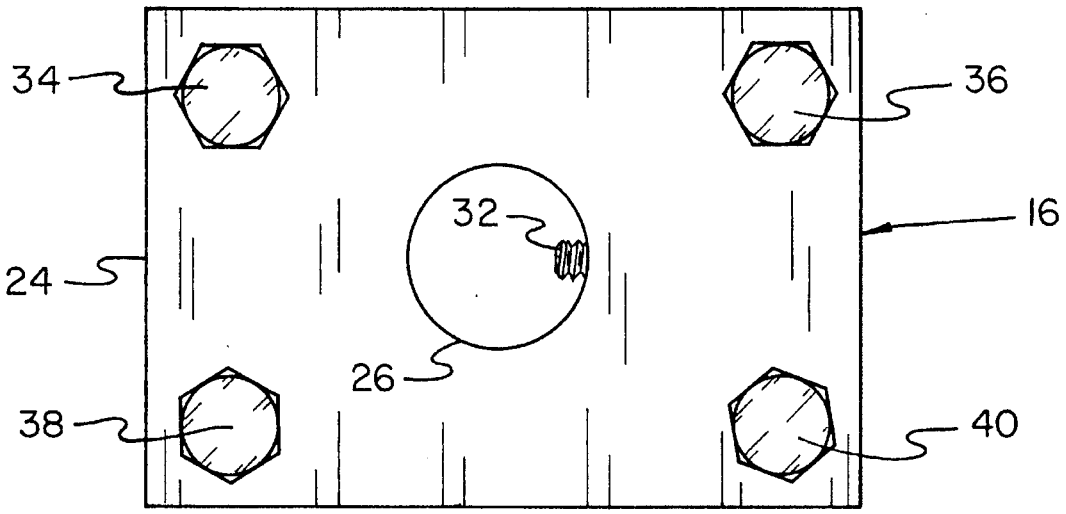
FIG. 3 is a top plan view taken along line 3—3 of FIG. 2.
Figure 4:
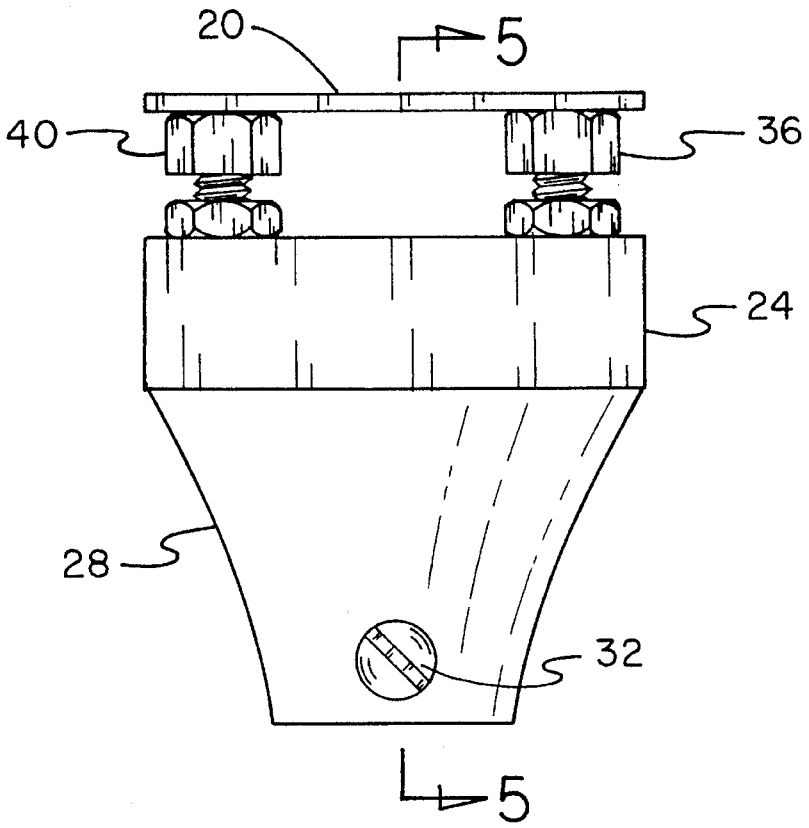
FIG. 4 is a side elevation view of the invention.

The fan alignment means 16 is operable to be positioned into abutting relation with the ceiling engagement means 12, whereby undesirable periodic oscillation of the ceiling fan is precluded. To effect adjustment of such abutting engagement between the fan alignment means 16 and the ceiling engagement means 12, a plurality of adjustment fasteners 34–40 are threadably engaged to an upper face of the mounting block 24, as shown in FIG. 3. The adjustment fasteners include a first adjustment fastener 34 spaced from a second adjustment fastener 36, and a third adjustment fastener 38 spaced from a fourth adjustment fastener 40. The adjustment fasteners 34–40 are positioned proximal to corners of the mounting block 24, with the mounting block preferably being rectangular in shape such that the first adjustment fastener 34 is spaced a first distance from the second adjustment fastener 36, and the third adjustment fastener 38 is spaced the first distance from the fourth adjustment fastener 40. Further, the rectangular shape of the mounting block 24 will inherently position the first adjustment fastener 34 a second distance from the third adjustment fastener 38, as well as position the second adjustment fastener 36 the second distance from the fourth adjustment fastener 40. Preferably, and as inherently defined by the rectangular configuration of the mounting block 24, the first distance is substantially greater than the second distance. By this structure, the fan alignment means 16, as well as the ceiling engagement means 12 can be angularly positioned into alignment with the direction of the greatest oscillation of the ceiling fan 14 as desired. In other words, the mounting block 24 can either be aligned with or positioned orthogonal to a direction of oscillation to either increase or decrease a counteracting force afforded by the device 10, respectively. To secure a position of the adjustment fasteners 34–40 relative to the mounting block 24, each of the adjustment fasteners is provided with a locknut 42 threadably engaged thereto which may be rotated into engagement with the upper face of the mounting block 24 to secure the adjustment fasteners in the desired position. Although not specifically illustrated, it is contemplated that the base plate 20 can be provided with a plurality of through extending mounting apertures to facilitate a securement of the base plate to the ceiling surface through a use of threaded fasteners, nails, or the like.

In use, the ceiling fan stabilizer 10 can be easily installed to an existing ceiling fan 14 by simply placing the fan alignment means 16 over the depending cylindrical support 18 and securing the same thereto by engaging the set screw 32 to the cylindrical support. The base plate 20 of the ceiling engagement means 12 can be positioned against the ceiling surface and secured thereto by threaded fasteners, nails, adhesives, or the like. The ceiling fan 14 can then be reengaged to the electrical box within the ceiling to position fan alignment means 16 against the ceiling engagement means 12. The adjustment fasteners 34–40 can then be selectively adjusted and secured by the locknut 42 to tightly engage the base plate 20, whereby periodic oscillating motion of the depending cylindrical support 18 and the associated ceiling fan 14 relative to the ceiling surface is precluded.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ceiling fan stabilizer comprising:

a ceiling engagement means for positioning against a ceiling surface above and proximal to a ceiling fan hanging from said ceiling;

wherein said fan alignment means includes a plurality of adjustment fasteners which can be threadably adjusted relative thereto to engage said ceiling engagement means to secure said depending cylindrical support and said associated ceiling fan against pivoting motion relative to said ceiling to preclude periodic oscillating motion of said ceiling fan.

2. The ceiling fan stabilizer of claim 1, wherein said ceiling engagement means comprises a substantially rectangular base plate having a base plate center aperture extending therethrough so as to permit positioning of said base plate against said ceiling and over an electrical box to which said ceiling fan is electrically and mechanically attached.

3. The ceiling fan stabilizer of claim 2, wherein said alignment means comprises a mounting block having a mounting block center aperture extending therethrough; a tapered neck coupled to and extending downwardly from a lower face of said mounting block, said tapered neck including a neck center aperture aligned with and positioned in contiguous communication with said mounting block center aperture, wherein said depending cylindrical support of said ceiling fan can be positioned through said center apertures; and a set screw threadably directed through said tapered neck and selectively engagable to said depending cylindrical support to secure said fan alignment means relative to said depending cylindrical support.

4. The ceiling fan stabilizer of claim 3, wherein said plurality of adjustment fasteners are threadably engaged to an upper face of said mounting block, said adjustment fasteners including a first adjustment fastener spaced from a second adjustment fastener, and a third adjustment fastener spaced from a fourth adjustment fastener, said adjustment fasteners being positioned proximal to corners of said mounting block, said mounting block being substantially rectangular in shape such that said first adjustment fastener is spaced a first distance from said second adjustment fastener, and said third adjustment fastener is spaced said first distance from said fourth adjustment fastener, and further such that said first adjustment fastener is positioned a second distance from said third adjustment fastener, and said second adjustment fastener is positioned said second distance from said fourth adjustment fastener, wherein said first distance is substantially greater than said second distance.

5. A ceiling fan stabilizer comprising:

a ceiling engagement means for positioning against a ceiling surface above and proximal to a ceiling fan hanging from said ceiling, said ceiling engagement means comprising a substantially rectangular base plate having a base plate center aperture extending therethrough so as to permit positioning of said base plate against said ceiling and over an electrical box to which said ceiling fan is electrically and mechanically attached;

and, a fan alignment means couplable to said ceiling fan for aligning said ceiling fan relative to said ceiling engagement means, said fan alignment means being couplable to a depending cylindrical support of said ceiling fan, said fan alignment means including a plurality of adjustment fasteners which can be threadably adjusted relative thereto to engage said ceiling engagement means to secure said depending cylindrical support and said associated ceiling fan against pivoting motion relative to said ceiling to preclude periodic oscillating motion of said ceiling fan; a mounting block having a mounting block center aperture extending therethrough; a tapered neck coupled to and extending downwardly from a lower face of said mounting block, said tapered neck including a neck center aperture aligned with and positioned in contiguous communication with said mounting block center aperture, wherein said depending cylindrical support of said ceiling fan can be positioned through said center apertures; a set screw threadably directed through said tapered neck and selectively engagable to said depending cylindrical support to secure said fan alignment means relative to said depending cylindrical support; and a locknut threadably engaged to each of said adjustment fasteners to secure a position of said adjustment fasteners relative to said mounting block, said plurality of adjustment fasteners being threadably engaged to an upper face of said mounting block, said adjustment fasteners including a first adjustment fastener spaced from a second adjustment fastener, and a third adjustment fastener spaced from a fourth adjustment fastener, said adjustment fasteners being positioned proximal to corners of said mounting block, said mounting block being substantially rectangular in shape such that said first adjustment fastener is spaced a first distance from said second adjustment fastener, and said third adjustment fastener is spaced said first distance from said fourth adjustment fastener, and further such that said first adjustment fastener is positioned a second distance from said third adjustment fastener, and said second adjustment fastener is positioned said second distance from said fourth adjustment fastener, wherein said first distance is substantially greater than said second distance.

* * * * *